US006550113B2

(12) United States Patent
Suchy et al.

(10) Patent No.: US 6,550,113 B2
(45) Date of Patent: Apr. 22, 2003

(54) CIRCULAR STRETCHERS FOR DRY TUBULAR FABRICS

(75) Inventors: Wolfgang Suchy, Gera (DE); Hartmut Hellwich, Mrhltheuer (DE); Joachim Labude, Gera (DE)

(73) Assignee: Suchy Textilmaschinenbau GmbH, Korbussen (DE)

( * ) Notice: Subject to any disclaimer, the term of this patent is extended or adjusted under 35 U.S.C. 154(b) by 0 days.

(21) Appl. No.: 10/096,027

(22) Filed: Mar. 12, 2002

(65) Prior Publication Data

US 2002/0129473 A1 Sep. 19, 2002

(30) Foreign Application Priority Data

Mar. 14, 2001 (DE) ..... 101 12 045

(51) Int. Cl.[7] ..... D06C 5/00
(52) U.S. Cl. ..... 26/80; 26/83
(58) Field of Search ..... 26/80, 81, 83, 26/84, 85, 82, 71, 72, 106; 34/104, 105, 437, 438, 439, 440, 441, 459, 623, 629

(56) References Cited

U.S. PATENT DOCUMENTS

| | | | | | |
|---|---|---|---|---|---|
| 1,597,702 | A | * | 8/1926 | Wenzel | 26/81 |
| 1,745,499 | A | * | 2/1930 | Marien | 26/81 |
| 1,808,879 | A | * | 6/1931 | Bates | 26/81 |
| 3,257,735 | A | * | 6/1966 | Catallo | 26/83 |
| 3,973,304 | A | * | 8/1976 | Catallo | 26/84 |
| 4,103,402 | A | * | 8/1978 | Frezza | 26/84 |
| 4,134,188 | A | * | 1/1979 | Bryan | 26/81 |
| 4,146,946 | A | * | 4/1979 | Plaia et al. | 26/84 |
| 4,262,397 | A | * | 4/1981 | Cecere | 26/84 |
| 4,266,983 | A | * | 5/1981 | Laszlo et al. | 34/452 |
| 5,867,879 | A | * | 2/1999 | Ferraro et al. | 26/83 |
| 5,884,376 | A | * | 3/1999 | Bertoldo | 26/80 |

FOREIGN PATENT DOCUMENTS

| | | |
|---|---|---|
| DE | 78 02 909 | 12/1977 |
| DE | 39 29 599 | 3/1991 |
| DE | 198 28 206 | 12/1999 |
| EP | 0 014 787 | 2/1979 |

* cited by examiner

*Primary Examiner*—Amy B. Vanatta
(74) *Attorney, Agent, or Firm*—Collard & Roe, P.C.

(57) ABSTRACT

The circular stretchers are arranged in front and back of a ring-shaped die, and must ensure that the tubular fabrics are transported on the ring-shaped die pressed down smoothly and without any folds.

The circular stretchers each have a spreader ring, which is held within the tubular goods completely free of attachment, and a centering ring locked to the spreader rings, which are positioned directly in front and back of the ring-shaped die in the running direction of the tubular fabrics.

The ring-shaped die is used for water removal or wet finishing dry tubular fabrics through vacuum extraction.

5 Claims, 1 Drawing Sheet

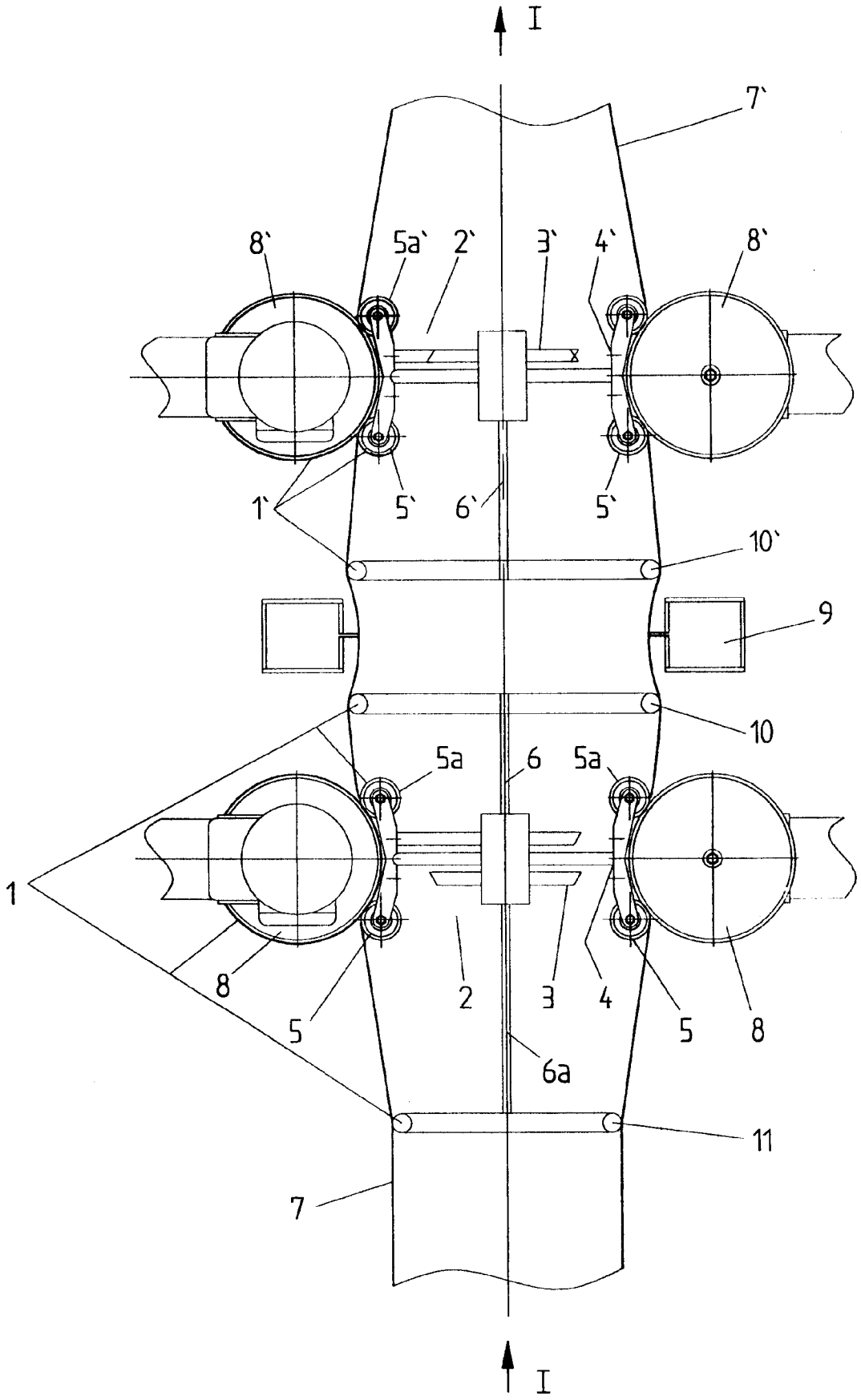
I
7`
8`
5a`
2`
3`
4`
8`
1`
5`
6`
5`
10`
9
10
5a
6
5a
1
8
5
2
3
4
5
8
6a
11
7
I

CIRCULAR STRETCHERS FOR DRY TUBULAR FABRICS

The invention relates to circular stretchers for dry tubular fabrics, which are situated in front and back of a ring-shaped die for water removal or wet finishing through vacuum extraction.

In this case, the stretched tubular fabrics are passed through a ring-shaped die that encompasses the tubular fabrics, and a liquid medium is extracted from the tubular fabrics by a stream of air or hot air, or a liquid medium is siphoned through the tubular fabrics.

Such a device with stretchers is described in DE PS 198 28 206.

In this solution, a circular stretcher with a spreader ring and guide rollers is arranged in the running direction of the tubular fabrics in front and back of a ring-shaped die. The spreader ring is located inside the tubular fabrics, and held completely free of attachment between the guide rollers positioned outside the tubular fabrics. The tubular fabrics are passed between the guide rollers and the spreader ring, and spread out in circular fashion based on the geometry of the spreader ring. In this way, the tubular fabrics are to be passed by the ring-shaped die pressed down smoothly and without any folds.

In another design described herein, the two spreader rings of the circular stretcher arranged in front and back of the ring-shaped die are connected by a tubular, annular insert, so that an annular gap comes about between the parison and the guide surfaces of the ring-shaped die through which the tubular fabrics are passed.

The objective of this is for the flowing medium to have to make its way through a significantly longer path within the tubular fabrics, thereby enhancing the effect of the vacuum extraction.

Threading the tubular fabrics through the ring-shaped die requires that the diameter of one of the spreader rings connected to each other by the tubular, annular insert be smaller than the inner diameter of the ring-shaped die.

Instead of the two spreader rings with the tubular, annular insert, use can also be made of a tubular, rigid spreader body with circular collars, which is carried by guide rollers with the collars in the running direction of the tubular fabrics in front and back of the slit die, so that a uniform annular gap again comes about between the spreader body and the guide surfaces of the ring-shaped die, through which the tubular fabrics are passed.

Threading in the tubular fabrics again requires that the diameter of at least one of the collars be smaller than the inner diameter of the ring-shaped die.

The ring-shaped die is here provided with annular ring-like guide surfaces axial to both sides of its die slit, against which the tubular fabrics should lie smoothly.

In addition, this solution provides that the guide surfaces be extended in a tubular fashion to one or both sides of the die slit of the ring-shaped die.

The ring-shaped die consists of a die ring body with expansion area and a die insert with a die slit running around the inner periphery.

The die insert is to be arranged in the die ring body, and be interchangeable for varying die inserts with an inner diameter corresponding to the respective body width of the tubular fabrics.

A sufficient vacuum extraction requires that the tubular fabrics lie smoothly against the die slit. However, this is only ensured in the solution described in DE PS 198 28 206 if the inner diameter of the ring-shaped die, the diameter of the spreader rings of the circular stretchers located in front and back of the ring-shaped die and the diameter of the tubular fabrics are identical, or at least the outer diameters of the spreader rings are greater than the inner diameter of the ring-shaped dies.

However, if the tubular fabrics are smaller in diameter than the spreader rings, the tubular fabrics are overstretched directly at the spreader rings. The tubular fabrics then return to their original size, and also do not come to lie sufficiently against the die slit.

If the diameter of one or both spreader rings is smaller than the inner diameter of the ring-shaped die, the tubular fabrics do not come to lie sufficiently against the die slit.

This means that solutions in which a spreader ring has a smaller diameter than the inner diameter of the ring-shaped die for reasons of technological expediency do not ensure the desired vacuum extraction.

In the described solution, die inserts tailored to each body width of the tubular fabrics are provided, with an inner diameter corresponding to the respective body width. However, the knowledge acquired from this makes it necessary to adapt not only the die inserts to the respective body width, but also the spreader rings.

This means that a large number of die inserts and spreader rings are required at body widths of 200 to 950 mm, for example, which must be replaced any time the body width changes.

Practice often necessitates a rapid change of body widths, which then always requires a lot of time for retrofitting.

Another problem involves the high frictional resistance between the guide rollers and spreader ring, which can result in material damage in the case of sensitive tubular fabrics.

To ensure a continuous processing of the tubular fabrics, individual piece lengths of the tubular fabrics are sewn together into an overall length with round seams, so that the round seams of the tubular fabrics can cause them to become jammed between the guide rollers and spreader ring.

The object of the invention is to improve a generic circular stretcher in such a way as to be able to vacuum extract dry tubular fabrics with a wide range of varying body widths without replacing the spreader rings of the circular stretcher, and with a single inner diameter of the ring-shaped dies, and also preclude material damages caused by excessive frictional resistance and avoid jamming at the round seams.

The object is achieved according to the invention with two generic circular stretchers arranged in the running direction of the tubular fabrics in front and back of a ring-shaped die, and with a spreader ring held completely free of attachment inside the tubular fabrics, which stretch the tubular fabrics in a circular fashion. According to the invention, the spreader ring consists of individual roller carriers offset on the inner periphery of the tubular fabrics, which are interconnected in a star pattern, and whose outer ends each have two stretching rollers spaced apart from each other, which are used to stretch out the tubular fabrics and the stretching rollers along with the tubular fabrics passed over them abut outer rollers, which are mounted between the stretching rollers.

In this way, the spreader rings with their stretching rollers are held completely free of attachment within the tubular fabrics.

To reduce the frictional resistance and largely avoid tensile stresses in the tubular fabrics, the outer rollers preferably have a drive.

The tubular fabrics passed through the stretching rollers and outer rollers are stretched out in a geometry predetermined by the star-shaped layout of the stretching rollers.

In order to make a shape adapted to the ring-shaped die, a centering ring locked to the roller carriers of the circular stretchers is positioned directly in front and back of this die, and has an outer diameter equal to or greater than the inner diameter of the ring-shaped die.

The centering ring preferably is shaped the same as the ring-shaped die. This ensures that the tubular fabrics will be transported on the die slit of the ring-shaped die stretched out smoothly and without folds.

The roller carriers of the spreader rings are adjustable radially toward the tubular fabrics, so that the stretching rollers always come to lie against the driven outer rollers with the stretched tubular fabrics.

The interaction between the stretching rollers and driven outer rollers thereby yields a slip-free transport of the tubular fabrics.

The roller carriers are adjusted in a manner known in the art, either by hand, under a spring resistance, with pneumatics or through exposure to a magnetic force.

An adjustable circular stretcher is known from DE OS 3929599. In this solution, the tubular fabrics are guided over outwardly swivelable supporting arms.

The circular stretcher described here has a completely different design. The circular stretcher is mounted inside the stretched tubular fabrics at its ends, which makes it unsuitable for solving the above task for this reason alone. This is accompanied by tensile stresses in the tubular fabrics and a higher frictional resistance that arise in this solution, and are to be avoided with the new solution.

In another embodiment of the new solution, a conveyor belt also runs over the stretching rollers of each roller carrier to further reduce the transportation forces acting on the tubular fabrics.

The diameter of the tubular fabrics is preferably smaller than the centering rings, so that the tubular fabrics are overstretched directly in front and back of the ring-shaped die.

This overstretching of the tubular fabrics established the precondition for the tubular fabrics to come to lie against the ring-shaped die over a wide range of body widths. In this case, a total overstretching of the tubular fabrics of up to approx. 75% is here possible without any damage. The maximal permissible overstretching $U_D$ determines which body widths (tubular fabric diameter) $D_{SW}$ can be used with a ring-shaped die diameter $D_D$–$\ddot{U}_D$=$D_D/D_{SW}$.

The tubular fabrics are advantageously overstretched not just starting at the centering rings, but already by the spreader rings, whose diameter is progressively adjustable. As a result, the frictional resistance at the centering rings is minimized.

In another embodiment, a stretcher device is locked to the spreader ring in front of it in the running direction of the tubular fabrics, and has a smaller diameter than that of the spreader rings. The stretcher device can be circular, spherical or hemispherical, or conical, etc.

Situating the stretcher device in front of the spreader ring brings about an incremental overstretching of the tubular fabrics, which further improves the stretching effect.

The solution according to the invention can be used to vacuum extract varying body widths within a wide range without replacing the spreader rings of the circular stretcher, and with a single inner diameter of the ring-shaped die. Material damage owing to an excessive frictional resistance and jamming at the round seams is precluded.

The invention will be described in greater detail below based on an embodiment.

The accompanying drawing shows a vertical arrangement with a ring-shaped die and a lower and upper circular stretcher. Both circular stretchers additionally have a centering ring, and the lower circular stretcher also has a stretching device.

The circular stretchers 1 and 1' are situated in the running direction I of the tubular fabrics 7 in front and back of a ring-shaped die 9 in a vertical arrangement. The tubular fabrics 7 are stretched into a circular pattern by spreader rings 2, 2' of the circular stretchers 1 and 1'. To this end, the spreader rings 2, 2' have at least three rollers 3, 3' offset on the inner periphery of the tubular fabrics 7, which are interconnected in a star pattern. Two stretching rollers 5, 5*a* and 5', 5*a'* are arranged at the outer ends of the roller carriers 3, 3' spaced a distance apart, and used to stretch out the tubular fabrics 7.

The stretching rollers 5, 5*a* and 5', 5*a'* lie with the tubular fabrics 7 guided over them against outer rollers 8, 8', which are mounted between the stretching rollers 5 and 5*a* as well as 5' and 5*a'*. In this way, the spreader rings 2, 2' of the circular stretchers 1 and 1' are held within the tubular fabrics 7 completely free of attachment.

The outer rollers 8, 8' are driven in the example. This greatly precludes tensile stresses in the tubular fabrics and reduces the frictional resistance.

The tubular fabrics 7 passed through between the stretching rollers 5, 5*a* and 5', 5*a'* and the outer rollers 8, 8' are stretched in a geometry predetermined by the star pattern of the stretching rollers 5, 5*a* and 5', 5*a'*.

In order to create a geometry adapted to the ring-shaped die 9, a centering ring 10, 10' is connected to the roller carriers 3, 3' of the circular stretchers 1, 1' via locks 6, 6' is positioned directly in front and back of this die, and has an outer diameter equal to or greater than the inner diameter of the ring-shaped die 9.

The centering rings 10, 10' have approximately the same shape as the ring-shaped die 9.

This ensures that the tubular fabrics 7 will be transported on the die slit of the ring-shaped die 9 stretched out smoothly and without folds.

The roller carriers 3, 3' of the spreader rings 2, 2' are adjustable radially toward the tubular fabrics 7, so that the stretching rollers 5, 5*a* and 5', 5*a'* always come to lie against the driven outer rollers 8, 8' with the stretched tubular fabrics 7. The interaction between the stretching rollers 5, 5*a* and 5', 5*a'* and driven outer rollers 8, 8' thereby yields a slip-free transport of the tubular fabrics 7.

The roller carriers are adjusted in a manner known in the art, either by hand, under a spring resistance, with pneumatics or through exposure to a magnetic force.

To further reduce the transportation forces acting on the tubular fabrics 7, a conveyor belt also runs over the stretching rollers 5, 5*a* and 5', 5*a'* of each roller carrier 3, 3'.

Overstretching the tubular fabrics 7 in front and back of the ring-shaped die 9 via the centering rings 10, 10' ensures that the tubular fabrics 7 come to lie against the ring-shaped die 9 over a wide range of body widths. In this case, a total overstretching of the tubular fabrics 7 of up to approx. 75% is here possible without any damage. The maximal permissible overstretching $\ddot{U}_D$ makes it possible to determine which body widths (tubular fabric diameter) $D_{SW}$ can be used with a ring-shaped die diameter $D_D$ ($\ddot{U}_D$=$D_D/D_{SW}$). This makes it possible to vacuum extract varying body widths of the tubular fabrics 7 within a wide range without replacing the spreader rings 2, 2' of the circular stretcher 1, 1' with a single inner diameter of the ring-shaped dies 9.

As shown in the example, the tubular fabrics are overstretched not just starting at the centering rings 10, 10', but already by the spreader rings 2, 2', whose diameter is progressively adjustable. As a result, the frictional resistance at the centering rings 10, 10' is minimized.

In another embodiment, a stretcher device 11 is connected by a lock 6*a* to the spreader ring 2 in front of it in the running direction I of the tubular fabrics 7, and has a smaller diameter than that of the spreader rings 2, 2'. The stretcher device 11 is circular or plate-shaped in the drawing. However, it can have other shapes as well.

In this way, the tubular fabrics 7 are pre-stretched via the stretching device 11. The tubular fabrics are then transported over the lower circular stretcher 1 with the stretching rollers 5 and 5*a*, as well as the driven outer rollers 8, wherein the tubular fabrics 7 become overstretched, and is then brought to lie tautly against the ring-shaped die 9 by the centering rings 10, 10' positioned under and over the ring-shaped die 9. The tubular fabrics 7 are then transported on via the upper circular stretcher 1'.

Situating the stretcher device 11 in front of the spreader ring 2 brings about an incremental overstretching of the tubular fabrics 7, which further improves the stretching effect.

List of Reference Numbers

1, 1' Circular Stretcher
2, 2' Spreader rings
3, 3' Roller carriers
4, 4' Outer ends of roller carriers 3, 3'
5, 5*a* Stretching rollers of circular stretcher 1
5', 5*a'* Stretching rollers of circular stretcher 1'
6, 6*a*, Locks
6' Locks
7 Tubular fabrics
8, 8' Outer rollers
9 Ring-shaped die
10, 10' Centering ring
11 Stretcher device
I Running direction of tubular fabrics 7

What is claimed is:

1. Circular stretchers for dry tubular fabrics, which are arranged in front and back of a ring-shaped die in the running direction of the tubular fabrics for purposes of vacuum extraction, and stretch out the tubular fabrics in a circular pattern by means of a spreader ring held within the tubular fabrics completely free of attachment, characterized in that the spreader rings (2, 2') consist of individual, at least three roller carriers (3, 3'), which are offset on the inner periphery of the tubular fabrics (7), interconnected in a star-shaped pattern and can be adjusted radially to the tubular fabrics (7), and whose outer ends (4, 4') each have two stretching rollers (5 and 5*a*, 5' and 5*a'*) spaced apart from each other, which stretch the tubular fabrics (7), and the stretching rollers (5 and 5*a*, 5' and 5*a'*) lie against outer rollers (8, 8') arranged outside the tubular fabrics (7) between the stretching rollers (5 and 5*a*, 5' and 5*a'*), and a centering ring (10, 10') locked to the roller carriers (3, 3') of the circular stretchers (1, 1') is positioned directly in front and back of a ring-shaped die (9), and has a diameter equal to or greater than the inner diameter of the ring-shaped die (9).

2. Circular stretchers according to claim 1, characterized in that the outer rollers (8, 8') have a drive.

3. Circular stretchers according to claim 1, characterized in that a conveyor belt is passed over the stretching rollers (5 and 5*a*, 5' and 5*a'*) of each roller carrier (3, 3').

4. Circular stretchers according to claim 1, characterized in that the diameter of the spreader rings (2, 2') is equal to or greater than the inner diameter of the ring-shaped die (9).

5. Circular stretchers according to claim 1, characterized in that a stretcher device (11) whose diameter is less than that of the spreader rings (2) is locked in the running direction (I) of the tubular fabrics (7) in front of the spreader ring (2) to its roller carriers (3).

* * * * *